US006602389B2

(12) United States Patent
Harvey et al.

(10) Patent No.: US 6,602,389 B2
(45) Date of Patent: Aug. 5, 2003

(54) PROCESS FOR TREATING A FIBROUS SLURRY OF COATED BROKE

(75) Inventors: Richard D. Harvey, Muscatine, IA (US); Stuart W. Mabee, Medina, OH (US); James M. Crandall, Pembine, WI (US)

(73) Assignee: Grain Processing Corporation, Muscatine, IL (US)

( * ) Notice: Subject to any disclaimer, the term of this patent is extended or adjusted under 35 U.S.C. 154(b) by 0 days.

(21) Appl. No.: 10/037,376

(22) Filed: Jan. 4, 2002

(65) Prior Publication Data

US 2002/0088565 A1 Jul. 11, 2002

Related U.S. Application Data

(60) Division of application No. 09/597,473, filed on Jun. 20, 2000, which is a continuation-in-part of application No. 09/173,875, filed on Oct. 16, 1998, now abandoned.

(51) Int. Cl.[7] ..... D21F 1/66; D21H 11/00

(52) U.S. Cl. ..... 162/191; 162/189; 162/183; 162/175; 162/168.3; 162/147; 162/164.1; 162/178; 162/181.1; 162/164.3

(58) Field of Search ..... 162/183, 181.8, 162/175, 168.3, 147, 189, 191, 164.1, 178, 181.1, 158, 164.3

(56) References Cited

U.S. PATENT DOCUMENTS

| | | | |
|---|---|---|---|
| 3,433,704 A | | 3/1969 | Hecklau et al. |
| 4,174,998 A | | 11/1979 | Shiel |
| 4,295,933 A | | 10/1981 | Smith |
| 4,372,814 A | | 2/1983 | Johnstone et al. |
| 4,388,150 A | | 6/1983 | Sunden et al. |
| 4,799,964 A | | 1/1989 | Harvey et al. |
| 4,889,594 A | | 12/1989 | Gavelin |
| 4,913,775 A | | 4/1990 | Langley et al. |
| 4,943,349 A | | 7/1990 | Gomez |
| 4,997,523 A | | 3/1991 | Pease et al. |
| 5,017,268 A | | 5/1991 | Clitherow et al. |
| 5,129,989 A | * | 7/1992 | Gosset et al. ..... 162/47 |
| 5,131,982 A | | 7/1992 | St. John |
| 5,466,338 A | | 11/1995 | Pearson |

FOREIGN PATENT DOCUMENTS

| | | |
|---|---|---|
| WO | WO 97/30222 | 8/1997 |
| WO | WO 00/345841 | 6/2000 |

OTHER PUBLICATIONS

Gibbs et al., "Flocculants for Precipitated Calcium Carbonate in Newsprint Pulps," *Tappi Journal*, 80 (4), 163–170 (1997).

Koppelman et al., "Quality Improvement in Standard Newsprint Through Filler Inclusion," *Tappi Proceedings*, 169–178 (1987).

Rahman, "Mechanism of Fines and Filler Retention in Newsprint Furnishes," *Tappi Proceedings*, 279–290 (1987).

Wason et al., "Pss Products for Newsprint and Groundwood Papers," *Pulp and Paper Canada*, 94 (8), 16–21 (1993).

* cited by examiner

*Primary Examiner*—Steven P. Griffin
*Assistant Examiner*—Dionne A. Walls
(74) *Attorney, Agent, or Firm*—Leydig, Voit & Mayer LTD

(57) ABSTRACT

Disclosed is a process for preparing a paper web. The paper web is prepared from a low-grade furnish, which contains low-grade pulps, such as recycled pulp and/or groundwood pulp, and which, in one preferred embodiment, is a newsprint furnish. In accordance with the disclosed process, a pre-flocculated filler is added to the furnish prior to forming the paper web from the furnish. Filler will be retained in the web, and retention of undesired components of the furnish in the web will be reduced as compared with newsprint in which a filler is incorporated via conventional processes. Another embodiment contemplates the incorporation of a pre-flocculated coated broke slurry into a paper furnish prior to paper formation. The paper web formed via the process of the invention will have improved properties as a result of the incorporation of the pre-flocculated filler or treated broke into the web.

5 Claims, 1 Drawing Sheet

PROCESS FOR TREATING A FIBROUS SLURRY OF COATED BROKE

This application is a division of copending U.S. patent application Ser. No. 09/597,473, filed Jun. 20, 2000, which is a continuation-in-part U.S. patent application Ser. No. 09/173,875, filed Oct. 16, 1998 now abandoned. Both parent applications are incorporated herein by reference by their entireties.

TECHNICAL FIELD OF THE INVENTION

The present invention is in the field of paper manufacturing. More specifically, the invention in one embodiment is directed towards a process for preparing a paper web, such as a sheet of newsprint, from low-grade paper furnishes. In another embodiment, the invention is directed toward a process for preparing a paper web from pulp that contains coated broke. The invention further is directed towards a paper web prepared in accordance with the inventive processes.

BACKGROUND OF THE INVENTION

Conventionally, paper is made by extracting a paper web from a slurry of wood pulp. In accordance with conventional papermaking processes, a furnish composed of wood pulp is provided and is introduced into a paper making machine. To the furnish are added various additives, the additives selected to affect the properties of the paper and the paper machine runnability. At the headbox of the paper making machine, pulp slurry from the headbox is deposited on a wire, and water is removed, thus forming a paper web from the slurry. The web is dried, optionally is collected on a reel, and subsequently is cut into sheets or otherwise converted for its intended application.

Generally speaking, paper may be classified into various grades, with higher grades of paper being known as "fine" papers, and with many lower grades also being known. The grade of paper is largely determined by the quality of the pulp in the paper furnish. One form of lower grade paper is newsprint, the paper stock that is used to print newspapers. Enormous quantities of newsprint are consumed daily by newspaper printers. Because of these high volumes and the short life expectancy of printed newspapers, printers and manufacturers of newsprint find it especially important to minimize the costs of newsprint stock, with cost generally being of somewhat more concern than paper quality. For this reason, newsprint furnishes typically contain lower grades of wood pulp than are found in furnishes that are used for the production of fine papers. For example, newsprint stock typically contains large amounts of groundwood stock and/or recycled paper stock. Typically, at least 30% of the pulp found in newsprint furnishes is composed of groundwood stock and/or recycled stock, and in some instances, as much as 100% of the pulp in the newsprint furnish is so composed.

Both groundwood stock and recycled paper stock typically contain large amounts of impurities. Such impurities can adversely affect the quality of paper produced from such furnishes. For example, groundwood stock is prepared via the high-yield mechanical processing of raw wood. Such stock typically contains relatively large amounts of components that are undesirable in the manufacture of paper, including such components as lignin, residue, pitch, resins, carbohydrates, fatty acids, and fiber fines. All of these components are believed to adversely affect various properties of the paper produced from groundwoods, such as strength, brightness, color, opacity, smoothness, and printability.

Retention aids also are used in connection with the manufacture of fine papers. Recycled stock and groundwood stock are sometimes used in the manufacture of fine papers in relatively smaller amounts than in newsprint. In the manufacture of such papers, the prior art teaches that the brightness, opacity, and other properties of the paper sheet may be improved by incorporating a filler into the paper furnish prior to forming a paper web therefrom. In conjunction with the preparation of such fine papers, fillers are believed to enhance opacity, brightness, color, smoothness, and printability properties. In addition, fillers may be used to provide improved machine runnability and a reduction in sheet cost. Conventional fillers are composed of fine particles, such as clays, which are not easily retained as the paper web is being formed from the pulp slurry. Accordingly, the prior art teaches to add a retention aid to the slurry to assist in retaining the filler material within the paper web. The use of such fillers in connection with retention aids has been satisfactory in connection with the manufacture of fine papers.

One source of recycled paper stock is "broke" stock, which typically is stock that failed to meet the particular specification for a given application and which therefore cannot be sold. Often, broke paper is coated with a variety of coatings, in which case it is termed "coated broke." Coatings typical of coated broke include pigments and adhesives which are intended to improve the properties of the product. Pigments, which are used in coating color formulations, usually are the main coatings, and generally provide between 80 to 95 percent of the total coating mass. Pigments include various forms of clay, calcium carbonate-both precipitated and ground, and titanium dioxide, among others. Adhesive materials generally are found in lower quantities, typically, between 8 to 20 percent of the total coating mass, and can include various modifications of starch and latex polymers such as styrene-butadiene, polyacrylics and polyacrylates. These components can adversely affect the properties of paper produced from coated broke. Recycled paper stock can contain other undesired components, including fine fibers, other chemical residues from prior paper processing, and possibly other undesired components. Moreover, because the quality and composition of recycled paper stock may vary from one source to another, the composition of recycled paper stock may be largely unknown. Accordingly, when recycled stock is provided in the furnish, a number of difficulties in maintaining the quality of paper prepared from such furnishes are encountered.

One of the problems associated with the production of paper from recycled paper stock, especially stock containing coated broke, is the accumulation of adhesive material in the wet end of a papermaking system. The accumulations known as "white pitch" form blemishes in the finished sheet, reducing its quality and often causing it to fail to meet desired specifications. White pitch also causes frequent web breaks in production runs, causes felt and wire clogging, and limits water drainage, all of which may result in decreased machine speed and increased machine downtime.

The prior art teaches that these difficulties with impurities can be addressed by adding retention aids, such as polyDADMAC, acrylamides, and epichlorohydrin/dimethylamine, to the pulp material. Retention aids cause the problematic substances to bind to the pulp fiber and be removed from the system as the fibers are retained in the newly formed paper web. However, the usefulness of this approach can be limited by the tendency of the treated pulp material to over-flocculate. Over-flocculation reduces machine performance by reducing the efficiency of sheet dewatering, with the result that physical sheet properties including formation, strength, and optical properties decrease. Use of retention aids also can thus be limited in maximizing the retention of broke material, thereby limiting the usefulness of the retention aid in mitigating against white pitch formation.

In recognition of these problems, the prior art has presented a number of proposed solutions. For example, U.S. Pat. No. 4,997,523 (Pease et al.) purports to disclose a method for treating coated broke using cationic and anionic coagulants. Another patent, U.S. Pat. No. 5,131,982 (St. John) purports to disclose treatment of coated broke using polyDADMAC. A third patent, U.S. Pat. No. 5,466,338, purports to disclose the use of a "water-soluble dispersive polymer" to treat repulped broke. These proposed solutions are not always satisfactory. These polymers can have a tendency to cause overflocculation of the sheet as it is being formed, leading to reduced properties including formation, strength, and optical properties.

Another limitation with the use of retention aids arises in the manufacture of newsprint and similar paper webs from lower-grade furnishes. In the manufacture of such webs, it is more difficult, and sometimes impractical to use a retention aid to incorporate a filler into the paper product. Because relatively large amounts of lower grade pulps are present in newsprint furnishes, impurities and other undesired components associated with such pulps are present in relatively large amounts. Thus, when attempts are made to incorporate a filler into, for example, a newsprint web, relatively large amounts of impurities are retained in the paper web along with the filler particles. The retention of such undesired components along with the filler particles largely or completely offsets any benefits obtained by the incorporation of the filler into the paper web.

For these reasons, a need exists for a process for preparing a paper web from low-grade newsprint pulps while incorporating a filler into the paper web. The process should avoid the drawbacks associated with conventional methods of incorporating a filler into a paper web. In some aspects of the invention, it is a general object to provide a process for preparing a paper web from lower-grade furnishes that include groundwood pulp, recycled pulp, or mixtures thereof, and for incorporating a filler into the paper web without also incorporating into the web amounts of impurities in the newsprint furnish that are sufficient to offset the benefits of incorporating the filler into the web. Another general object of these aspects of the invention is to efficiently retain a filler in a newsprint web while maintaining the beneficial properties of the filler.

A further need exists for a process for preparing paper from recycled pulps that contain coated broke. The method should alleviate the white pitch problem associated with the use of coated broke, and should avoid over-flocculation that interferes with efficient paper production and paper quality. It is a general object of this aspect of the invention to provide a process for producing paper from recycled pulps that reduces or eliminates the white pitch problem.

SUMMARY OF THE INVENTION

It has now been found that newsprint may be prepared from lower-grade pulp furnishes by adding a pre-flocculated filler to the furnish prior to forming a paper web therefrom. Surprisingly, it has also been found that, when filler is incorporated via the addition of a pre-flocculated filler, rather than by adding conventional filler and subsequently adding a retention aid, impurities such as lignin, pitch, ink particles, and other impurities commonly found in newsprint furnishes will not be incorporated into the paper web to the same degree as with the conventional process. Even more surprisingly, many properties of a newsprint sheet prepared from such furnishes are substantially improved as compared with those of conventionally prepared newsprint sheets.

Thus, the process of the invention includes the steps of providing a newsprint furnish, adding a pre-flocculated filler to the furnish, and forming a paper web from the furnish. Typically, the web will be dried, printed with newspaper ink and subsequently cut into sheets.

In accordance with a particularly preferred embodiment of the present invention, the pre-flocculated filler is prepared in accordance with the teachings of U.S. Pat. No. 4,799,964, issued to Richard D. Harvey et al. and assigned to Grain Processing Corporation of Muscatine, Iowa, which is incorporated herein by reference in its entirety. The process for forming a pre-flocculated filler taught in the foregoing patent comprises continuously bringing together an aqueous slurry of a paper filler material and a flocculating agent, and imparting to the mixture a shearing force sufficient to provide a flocculated filler of controlled particle size. When a pre-flocculated filler is prepared in accordance with the preferred embodiment of the invention and added to the newsprint furnish, a newsprint of high quality may be economically prepared.

It has also been found that paper formation from furnishes containing recycled broke pulp is facilitated by adding a flocculating chemical to the recycled pulp before the recycled pulp is added to a paper furnish, and by applying a sufficient shearing force to the flocculated pulp to reduce or maintain the flocs to a size that is effective to enhance the retention of flocs in a paper web. Surprisingly, this process not only reduces white pitch problems, but also improves paper qualities including such properties as formation strength and opacity, as compared to paper prepared from conventional recycled coated broke.

The invention also encompasses paper webs made in accordance with the foregoing processes.

DESCRIPTION OF THE PREFERRED EMBODIMENTS

In one embodiment, the invention contemplates the preparation of newsprint and similar paper webs from newsprint furnishes. Newsprint furnishes are low-grade fibrous pulp slurries suitable for the production of newsprint, as opposed to fine papers. Typically, at least 30% of the pulp in the newsprint furnishes include groundwood pulp, recycled pulp, or mixtures thereof. The groundwood pulp in the furnish may be prepared from any suitable wood species. Recycled pulp may be any mechanically recycled pulp, thermomechanically recycled pulp, chemithermomechanical pulp, or other suitable recycled pulp furnish. Newsprint furnishes made from such low-grade pulps typically contain substantial amounts of lignin, resins, fatty acids, pitch, ink particles, chemical residues from prior paper processing, pulp fiber fines, and other undesired components, the components and amounts of such components sometimes being unknown. Such furnishes typically contain substantially larger amounts of such undesired components as compared to fine paper furnishes.

Figure 1:
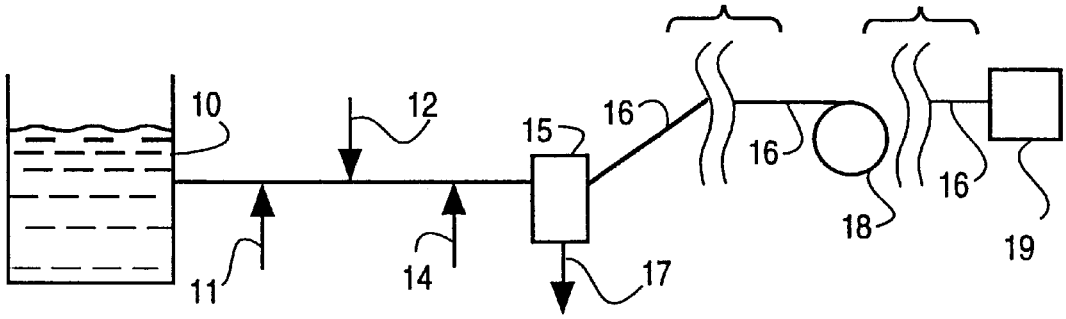
FIG. 1 PRIOR ART
FIG. 1 is a schematic representation of a conventional papermaking process.

FIG. 1 represents a prior art process for the manufacture of fine paper. In accordance with this process, a fibrous pulp slurry 10 is provided. To the slurry 10 is added a filler at step 11. Subsequently, at step 12, a retention aid is added. Optionally, other additives are added to the slurry at step 14, the type and composition of these additives and their order of addition being conventional and within the level of skill in the art. At the headbox 15, a web 16 is formed from the furnish, and the whitewater is removed at step 17. In subsequent steps, the web 16 is dried (not shown), optionally rolled at step 18, and cut into sheets at step 19. The prior art teaches that this process may be used in the manufacture of fine papers. When fillers and a retention aid are added to a newsprint furnish in the manufacture of newsprint, however, substantial amounts of undesired components are retained in the paper web 16, thus detracting from the quality of the newsprint sheets ultimately prepared therefrom.

Figure 2:
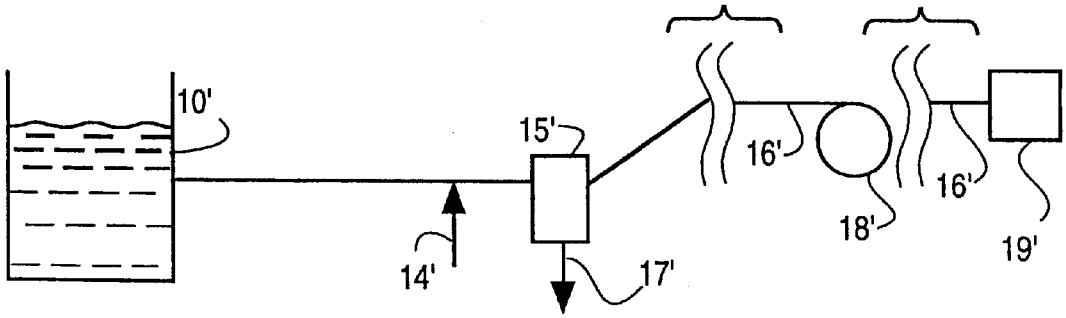
FIG. 2 is a schematic representation of the process for preparing a paper web in accordance with the embodiment of the present invention.

The process of the invention is represented in FIG. 2. In accordance with the invention, a pre-flocculated filler is added to the furnish prior to the headbox 15'. Preferably, pre-flocculated filler is added at the fan pump 20 or at other locations as close to the headbox as possible, but pre-flocculated filler may be added at any other suitable time. Filler that has not been pre-flocculated also may be added at any suitable time, although such generally is not preferred. As shown in FIG. 2, the process of the invention includes providing a newsprint furnish in the form of a fibrous pulp slurry at step 10', adding the pre-flocculated filler at step 21, and forming the paper web 16' from the slurry leaving whitewater, the whitewater being removed at step 17'. The web preferably is formed conventionally, that is, by depositing the slurry on a wire and removing the whitewater to thus form a web. The paper web may be dried (not shown) optionally rolled to form a paper roll at step 18', and subsequently cut into sheets at step 19'. The web may be printed either before or after the web is cut into sheets. In the manufacture of newspapers, printed matter typically is applied to a roll -of newsprint before the newsprint is cut into sheets and subsequently assembled to form a newspaper. Other additives may be added, for example at step 14', and otherwise the process may be conventional and practiced with conventional paper manufacturing equipment or otherwise as is suitable.

Preferably, the pre-flocculated filler is provided in accordance with the teachings of U.S. Pat. No. 4,799,964. In accordance with this highly preferred embodiment of the invention, the process for preparing the flocculated filler comprises the steps of continuously introducing an aqueous slurry of a non-flocculated filler material and an aqueous slurry of from about 0.05% to about 60% by weight of the filler material of a flocculating agent into a shear imparting device, imparting to the mixture within the device a shearing force sufficient to provide flocculated filler particles of a size adapted for use in paper making, and continuously removing the flocculated filler particles from the shear imparting device. No additional treatment of pre-flocculated filler ordinarily will be required. However, while the pre-flocculated filler preferably is provided in accordance with the teachings of the foregoing patent, the pre-flocculated filler may be provided in accordance with any other suitable method, such as a batch method.

Any suitable filler material may be used in conjunction with the present invention. Preferred examples of conventional filler materials include clays, such as china clay, lithopone, sulfate fillers, pigments, such as titanium pigments, titanium dioxide, satin white, talc, calcium carbonate, barium sulfate, gypsum, chalk, and so forth. Particularly suitable fillers include kaolinitic clays, calcined clay, ground and precipitated calcium carbonate, and titanium dioxide. The choice of filler material is not critical to the invention, and may vary depending on the choice of one skilled in the art based on criteria such as properties desired, availability, and cost. The ability to provide such filler and to retain it effectively in the paper web increases the papermaker's options in selecting a suitable filler.

Any suitable flocculating agent may be employed in preparing a pre-flocculated filler in conjunction with the invention. For example, conventionally known retention aids may be employed as flocculating agents. Flocculating agents are employed to flocculate together the filler particles and the cellulosic fibers in the paper web. Generally, organic polymers of a high molecular weight are known to be useful as flocculating agents. Suitable flocculating agents include water-soluble vinyl polymers and gums, polacrylamides, aluminum sulfate, mannogalactanes, and anionic and cationic starch derivatives.

The anionic starch derivatives useful as flocculating agents generally are starch derivatives that contain substituent acid groups such as carboxyl, phosphate, sulfate, or sulfonate groups. Representative of such derivatives are sodium chloroacetate, phosphoryl chloride, sodium trimetaphosphate, and acid anhydrides, such as acetic, maleic, malonic, proprionic, and the like. Other starch derivatives also are useful as flocculating agents. For example, starch derivatives that contain primary, secondary, and or tertiary amino groups or a quaternary ammonium group may be used. The starches also can be cross-linked, dextrinized, oxidized, hydrolyzed, etherified, estherified, or otherwise modified. Cationic starch derivatives are regarded as preferred in connection with the invention. Representative of such cationic starch derivatives are starch derivatives having a degree of substitution (DS) in a range of about 0.01 to 0.15, preferably about 0.03 to about 0.075. Representative of such cationic starches include derivatives from chlorohydroxylpropyl trimethyl ammonium chloride, diethylaminoethyl hydrochloride, chlorylbutenyl trimethyl ammonium chloride, 3-chloropropyltrimethylammonium chloride N-(3-chloro-2-hydroxypropyl) pyridinium chloride, ethyleneimine and the like. The invention is not limited to the foregoing starches, and anionic starches or amphoteric starches also are contemplated to be suitable for use in conjunction with the invention.

The amount of the flocculating agent used in conjunction with the invention can vary widely and, in general, any suitable amount may be used. For example, the flocculating agent can be present in an amount ranging from about 0.05% to about 60% by weight of the filler material. Preferably, the flocculating agent is present in an amount ranging from about 0.2 to about 4% by weight of the filler material. In connection with the pre-flocculation of the filler, the flocculated filler particle size can increase from about 2 times to about 50 times that of the unflocculated filler particle, and preferably from about 2.5 to about 25 times the original filler size. The preferred filler comprises clay and/or calcium carbonate that has been pre-flocculated with a cationic starch paste flocculating agent or polyacrylamide flocculant.

In accordance with the invention, the pre-flocculated filler is added to the pulp in an amount sufficient to impart at least one property to the paper web; and preferably is added in an amount sufficient to provide at least 1% by weight of filler in the paper web formed from the pulp slurry, at least a portion of this 1% filler in the web being present as a result of the addition of said pre-flocculated filler. The furnish may already have included some filler prior to addition of the pre-flocculated filler, especially when the newsprint furnish includes recycled pulp. Some of this filler may become incorporated into the paper web via mechanical entrapment or chemical retention. Thus, it is not necessary that all of the filler in the paper web be present as a result of the addition of the pre-flocculated filler to the furnish. Preferably, filler added as a result of the pre-flocculated filler is present in the web in an amount ranging from about 1% to about 10% by weight, preferably from about 2% to about 5% by weight, with other fillers being present in an amount as small as is practical, preferably-no more than about 2.5% to about 4% by weight. The total filler content of the web preferably is at least about 5% by weight, more preferably about 7.5% by weight. Preferably as the selection of relative flow rates of the paper furnish and of the pre-flocculated filler to achieve the desired filler retention is within the level of skill in the art. Typically, the pre-flocculated filler is added to the furnish in an amount ranging from about 80 lb/ton to about 200 lb/ton of dry furnish, preferably about 80 lb/ton to about 100 lb/ton in some applications.

Surprisingly, when a pre-flocculated filler is added to a newsprint paper furnish in accordance with the present invention, the retention of substantial amounts of impurities in the web is avoided. Enhancements in strength, brightness, opacity, and other properties of the newsprint sheets prepared from the paper web relative to paper that has not been prepared using a pre-flocculated filler may be realized.

The present invention is also directed to a method of treating a coated broke, and for preparing a paper web from such treated coated broke. In accordance with this aspect of the invention, a repulped slurry of coated broke is first provided. The coated broke material, which typically contains pigments and adhesives, and which may contain other materials, can be provided by repulping the coated broke using agitation and water.

In accordance with the invention, a chemical flocculant is added to the slurry, and a shearing force is applied to the slurry. The chemical flocculant should be added in an amount effective to form floccs, the floccs including fiber and particles of coating residue. Preferably, the chemical flocculant is added in an amount ranging from about 0.05% to about 60%, and more preferably from about 5% to about 15%, by weight of the coated broke material. The shearing force should be applied in an amount effective to limit the size of the floccs to a size that is effective to enhance the retention of floccs when a paper web is withdrawn from the slurry. It is believed that the shearing force will control the size of the floccs, or will prevent the floccs from reaching an "overflocculated" state in which the size of the floccs limits the the formation, strength, and optical properties for the corresponding paper web.

Any suitable broke stock can be used in conjunction with the present invention. For example, coated broke stock that contains components such as pigments, clay, carbonate, titanium dioxide, starch, adhesives, base stock fibers, and other materials can be used. Chemical pulps, mechanical pulps, recycle stock, and variations thereof can all be incorporated as components of suitable coated broke slurries. As discussed above, the coated broke slurry will typically contain pigments and adhesive materials, and may include, for example, such materials as clay, calcium carbonate, titanium dioxide, starch, latex adhesives, and other components. Likewise, any suitable flocculating agent may be employed in preparing a pre-flocculated broke slurry in conjunction with the invention. For example, those flocculating agents discussed above advantageously are employed. Representative flocculating agents useful in conjunction with this aspect of the invention include water-soluble vinyl polymers and gums, polyacrylamide, polyDADMAC, aluminum sulfate, mannogalactanes, and charged starch derivatives (including both anionic and cationic derivatives).

The shearing force may be applied to the broke slurry by any suitable means. Most preferably, the coated broke is treated in a manner that is somewhat analogous to the teachings of U.S. Pat. No. 4,799,964. In accordance with this embodiment of the invention, the process for preparing the flocculated coated broke slurry comprises the steps of continuously introducing an aqueous slurry of the coated broke material and the flocculating agent into a shear imparting device, imparting to the mixture within the device a shearing force, and continuously removing the pre-flocculated coated broke fibers from the shear imparting device. The amount of flocculant used in the shear imparting device should be as described above.

The shear imparting device preferably is a typical centrifugal-type pump and, in particular, centrifugal pumps that operate against a back pressure that is greater than the pump shut-off pressure are convenient and suitable devices. Other suitable means for imparting mechanical shear include, for example, homogenizers, shear pumps, emulsifiers, sonic emulsifiers, colloid mills, high speed wet mills, jets, high intensity mixers, and the like. The intensity of the shearing force to which the mixture is subjected can vary widely depending upon the specific shear imparting apparatus and flow rates employed. Generally, the shearing force should be applied to provide a uniformly distributed slurry in which the floccs of fiber, filler, and pitch have a particle size effective to enhance the retention of the floccs in the paper web. The absolute magnitude of the flocc size is not critical, and may vary from application to application. Generally, the flocc size will be too big when the paper web exhibits non-uniform formation, as may be evident, for example, upon visible inspection. No minimum flocc size is contemplated by the invention, although in practice, in most applications, the flocc size should not be made so small that the retention of the floccs in the web becomes non-uniform in the "z" direction of the web, i.e., such that the paper web exhibits an undesirable "two-sidedness." Those skilled in the art will appreciate that the shearing force can be controlled to produce this result by any means suitable for use in the apparatus chosen. Preferably, and with reference to the shear equation set forth at column 4, line 55 of U.S. Pat. No. 4,799,964, the shearing force can range from about 2800 to about 9200 $s^{-1}$.

In preparing a paper web, it is contemplated that a paper web may be prepared from the treated coated broke slurry without adding additional fiber. However, in preferred embodiments of the invention, the treated coated broke slurry is added to another fibrous pulp slurry, preferably a virgin pulp slurry, to form a combined pulp slurry, and a paper web then is withdrawn from the combined pulp slurry in conventional or otherwise suitable fashion. Most preferably, the coated broke slurry is added in an amount ranging from about 0.1% to about 30%, more preferably about 5% to about 25% of the other fibrous pulp slurry (those percentages being by weight of dry fiber). When the coated broke is used in connection with a conventional papermaking machine and added to the other components of a papermaking furnish, the pre-flocculated coated broke pulp slurry can be added to the furnish at any suitable point in the papermaking process, generally, after the refiners, depending upon the machine design. The paper web preferably is formed conventionally by depositing the slurry on a wire and removing the whitewater to form a web. The web thus formed can be handled by any appropriate conventional means depending on particular requirements for the product.

When a pre-flocculated coated broke pulp is added to a furnish in accordance with the present invention, the retention of both fiber pigment, binders, and other coating additives increases. Such improved retention is believed to reduce the formation of white pitch deposits in the papermaking machine, thereby providing improved machine efficiency via reduced breaks and downtime, and increasing productivity. In addition, the properties of the paper web prepared using the treated coated broke slurry of the invention surprisingly are comparable to or improved over paper prepared using coated broke slurries that have not been treated in accordance with the invention. Paper properties improved by pretreatment of the coated broke include formation, strength, porosity, optical properties, and reduced defects, such as holes, fish eyes, and the like.

EXAMPLES

The following examples illustrate the present invention, but should not be construed as limiting the invention in scope.

Example 1

Evaluation of Retention Characteristics

This Example provides a comparative evaluation of the retention of filler and of undesired components as would be observed in the preparation of a paper web, as between the process of the invention and a conventional process.

Preparation of Pre-Flocculated Filler

Following the teachings of U.S. Pat. No. 4,799,964, an aqueous slurry of clay at a dry solids content of 20% was pumped into a centrifugal mixing device at a rate of 3300 ml/min. Simultaneously, a 1% cationic polacrylamide-based flocculating agent was pumped into the mixture at a rate of 150 ml/min, thus resulting in a dry flocculant to dry filler add-on level of 0.2%.

Flocculated clay particles were produced continuously in the mixing device. The flocculated slurry was collected at the discharge of the mixing device. Using a Malvern Instruments Mastersizer particle size analyzer, the pre-flocculated filler was found to have a medium particle size of 13.87$\mu$, as compared to a medium particle size of 5.25$\mu$ in the initial clay slurry.

Evaluation of Retention Characteristics

Using a Dynamic Drainage Jar, available from Paper Research Materials, Inc. 770 James Street, Apartment 1206, Syracuse, N.Y., or from Paper Chemistry Laboratories, Inc., Stonleigh Avenue, Carmel, N.Y., the retention properties of the pre-flocculated filler were evaluated. The Drainage Jar was equipped with a 200-mesh screen. To the Drainage Jar was added a furnish prepared from a blend of thick stock and whitewater obtained from Jefferson Smurfit Company, Newberg, Oreg. The thick stock was a combination of approximately 50% mechanically pulped fiber, and 50% recycled fiber. The whitewater had been obtained from a paper machine making newsprint, and thus the whitewater included unretained components of the paper-making furnish. The stock pH was adjusted to 5.5 with sulfuric acid, and the ash level of the stock was found to be 9.6%.

A 500 ml charge of this combined furnish at approximately 0.50% consistency was added to the Drainage Jar under agitation of 750 RPM to provide a furnish in the Jar. The pre-flocculated clay was added at 5%, or 100 lb/ton, on fiber from a 20% slurry. The 20% clay slurry was produced by diluting a 70% aqueous slurry with tap water. The clay was KAOFILL Kaolin, obtained from Thiele Kaolin Company, Sandersville, Ga. No additional flocculant was added. The furnish was allowed to mix for 10 seconds prior to drainage. A 30 ml aliquot was collected and then discarded to ensure the collection of an untainted sample for testing. Then, a 100 ml sample was collected, filtered, ashed, and analyzed for total retention and for filler retention.

For comparative purposes, a 500 ml charge of the dilute stock was added to the Drainage Jar at 750 RPM. Unflocculated clay was added at 5% on fiber from a 20% slurry. After allowing 10 seconds for mixing, the flocculating agent that had been used to form the pre-flocculated filler as set forth above was added as a retention aid. This retention aid was added at a level of 0.3 lb./ton (0.015%). The furnish was allowed to mix for an additional 5 seconds prior to drainage. A 30 ml aliquot was collected and discarded, and a 100 ml sample was then collected and analyzed for total retention and for filler retention. As a control, the experiment was repeated, except that unflocculated clay was added to the Jar with no retention aid.

The total retention and filler retention were as follows:

TABLE I*

| | Total Retention | Filler Retention |
|---|---|---|
| Control (No flocculant) | 21.55% | 1.84% |
| Conventional Process (0.3 lb./ton total retention aid) | 25.26% | 11.57% |
| Pre-Flocculated Filler (0.2 lb/ton total flocculant) | 21.76% | 13.27% |

*Each retention value reported is the average of two tests.

This example illustrates that the use of pre-flocculated filler provides an increase in filler retention greater than that achieved with the conventional process, which employed an unflocculated filler and subsequent addition of a retention aid. The pre-flocculated filler was able to achieve this result with 33% less flocculating agent than used in connection with the conventional process. Moreover, the use of a flocculated filler did not significantly affect non-filler retention as compared with the control, when no retention aid was employed. Surprisingly, this illustrates an ability to selectively control retention.

Example 2

Evaluation of Retention Characteristics

This Example provides a further comparative evaluation of the process of the invention as compared with a conventional process.

Preparation of a Pre-Flocculated Filler

In accordance with the procedure of Example 1, a clay slurry at 20% solids concentration was continuously mixed with a flocculant solution in the amount of 0.4% dry flocculant to dry filler add-on level. The resulting flocculated filler had a median particle size of 78.56$\mu$.

Evaluation of Retention Characteristics

Using a Dynamic Drainage Jar and the paper stock used in Example 1, pre-flocculated filler was added to the stock in an amount of 0.4 lb. flocculating agent per ton furnish (0.020%). No additional flocculating agent was added.

For comparative purposes, unflocculated clay was added to a Dynamic Drainage Jar. The flocculating agent that had been used in the preparation of pre-flocculated filler was added as a retention aid. The retention aid was added at a level of 0.4 lb. flocculating agent per ton furnish (0.02%). As a control, unflocculated filler was added to the Jar without using a retention aid.

Total retention, filler retention, and non-filler retention were evaluated, and the following results were obtained:

TABLE 2

| | Total Retention | Filler Retention | Non Filler Retention |
|---|---|---|---|
| Control | 21.6% | 1.8% | 27.5% |
| Conventional | 25.4% | 10.3% | 30.0% |
| Pre-Flocculated Filler | 24.1% | 13.0% | 27.4% |

These results illustrate that the flocculated filler provides a significant increase in filler retention as compared to the conventional process. Surprisingly, non-filler retention did not significantly change as between the flocculated filler and the control, and non-filler retention was less for the process of the invention as compared with that of the conventional process. Again, this indicates an ability to selectively control retention.

Example 3

Preparation of Handsheets and Brightness Evaluation

This Example illustrates the preparation of handsheets and the evaluation of the brightness (GE Scale) of the handsheets.

In accordance with the procedures set forth in Example 1, pre-flocculated clay filler was prepared. The flocculated clay filler was added to a 500 ml charge of furnish in a Dynamic Drainage Jar at 750 RPM agitation. Filler was added at 5% on fiber containing the equivalent of 0.2 lb. flocculent per ton furnish (0.010%). After applying the furnish to the filler within the Dynamic Drainage Jar, the charge of stock was immediately transferred to a handsheet apparatus, and a handsheet was formed. The sheet was pressed twice at 5 minutes and at 2 minutes, dried on drum dryer at 100° F. (38° C.) for approximately 20 minutes, and allowed to cure overnight in a constant temperature/humidity room. A second handsheet was prepared using 10% flocculated clay filler. For comparative purposes, similar handsheets were formed using comparable amounts of filler and adding the flocculating agent as a retention aid after the filler was added to the furnish in the Dynamic Drainage Jar. Control handsheets were also prepared without the addition of filler or retention aid to the Jar.

Each set of handsheets was analyzed for GE brightness, and for filler content. From these results, brightness values for a given ash value for flocculated, unflocculated, and zero virgin filler addition were evaluated for comparison with the control handsheet. The following results were obtained:

TABLE 3

| | PERCENT SHEET FILLER CONTENT | BRIGHTNESS (GE Scale) |
|---|---|---|
| Flocculated Filler | 7.3% Interpolated (3% Virgin) | 53.2 |
| Non-flocculated Filler | 7.3% Interpolated (3% Virgin) | 51.2 |
| Control-No Virgin Filler | 4.3% (0% Virgin) | 52.2 |

These results demonstrate that the use of an unflocculated filler with a retention aid in accordance with conventional teachings causes the brightness to drop in comparison to the control handsheet wherein no retention aid is used. This drop in measured brightness is believed to be due to the retention of unwanted components of the furnish in the sheet. Surprisingly, and in contrast, the use of a pre-flocculated filler in accordance with the process of the invention caused a significant increase in measured brightness. This increase in brightness is believed to be due to the presence of filler in the sheet, and to the fact that undesirable components of the furnish were not incorporated in amounts sufficient to offset the benefits of the retention of filler. These results illustrate the benefits of selectively controlling retention.

Example 4

Preparation of Handsheets and Evaluation of Strength Properties

Handsheets were prepared in accordance with Example 3. Each of the handsheets was analyzed for strength properties, including Scott bond strength and Mullen strength. The results were interpolated to a given filler content to compare with the control. The following results were obtained:

TABLE 4

| | Filler Content | Scott Bond | Mullen |
|---|---|---|---|
| Control | 4.3% (0% Virgin) | 119.4 | 7.5 |
| Non-flocculated Filler | 7.3% Interpolated (3% Virgin) | 126.5 | 17.5 |
| Flocculated Filler | 7.3% Interpolated (3% Virgin) | 127.8 | 18.5 |

These results indicate that the use of a pre-flocculated filler provides a paper web with improved Scott bond strength and Mullen bursting strength, as compared with a web prepared in accordance with the conventional process and a web prepared with no retention aid. These results illustrate the benefits of selectively controlling retention.

Example 5

Preparation of Handsheets and Evaluation of Opacity

Handsheets were prepared in accordance with Example 3, and the opacity of the handsheets was evaluated. The following results were obtained:

TABLE 5

| | Filler Content | Opacity |
|---|---|---|
| Control | 4.3% (0% Virgin) | 97.30 |
| Non-flocculated Filler | 7.3% Interpolated (3% Virgin) | 97.97 |
| Flocculated Filler | 7.3% Interpolated (3% Virgin) | 98.23 |

These results indicate that the process of the invention provides an increase in opacity greater than can be obtained at equivalent filler levels with a conventional process. These results illustrate the benefits of selectively controlling retention.

Example 6

Handsheets prepared in accordance with Example 3 were tested for caliper and for porosity using a Gurley Densimeter. The following results were observed:

TABLE 6

| | Filler Content | Caliper | Porosity |
|---|---|---|---|
| Control | 4.3% (0% Virgin) | 6.03 | 89.48 |
| Non-flocculated Filler | 7.3% Interpolated (3% Virgin) | 8.86 | 88.64 |
| Flocculated Filler | 7.3% Interpolated 3% Virgin) | 6.29 | 96.4 |

The significantly greater caliper observed with the conventional process was believed to be due to bundling of fibers and poor sheet formation. Similarly, the loss of porosity of the sheet prepared in accordance with the conventional process was believed to be due to poor sheet formation. As is known in the art, as sheet formation deteriorates, the sheets tends to become more porous; similarly, it is known that a change in caliper is an indication of a significant change in formation. The relatively poor quality of sheet formation of the sheet prepared by the conventional process was confirmed by visual inspection.

In contrast to the conventional process, the process of the invention provided a handsheet with a surprising slight increase in caliper and decreased porosity as compared to the control handsheet. The handsheets were visually inspected, and the handsheets that were prepared in accordance with the present invention appeared to be better formed as compared with the control sheet and that prepared in accordance with the conventional process. These improved properties enhance both paper printability and print quality of the paper sheets. These results illustrate the benefits of selectively controlling retention.

Example 7

This Example provides a comparison of the retention exhibited in various paper furnishes prepared using recycled coated broke.

A papermaking furnish was prepared using 25% bleached Kraft softwood and 75% bleached Kraft hardwood, refined to 300 Canadian Standard Freeness using a Valley beater. This furnish had a consistency of 0.50%, which is typical for headbox furnishes. The retention characteristics of this slurry in combination with coated broke were evaluated using a Dynamic Drainage Jar.

To evaluate the retention characteristics of a paper furnish prepared in accordance with the invention, a coated broke obtained from a commercial paper mill was repulped using a Valley beater and water to a target consistency of 0.50%. This slurry was found to contain a pigment content of approximately 24%. This slurry was pumped at a rate of 3200 ml/min., to a centrifugal mixing device. A 1% cationic polyacrylamide-based flocculant was simultaneously pumped through the mixer at a rate of 160 ml/min., thus giving a dry flocculant to broke add-on level of 10.0%.

A 500 ml charge of the headbox stock was added to the Drainage Jar using 750 RPM agitation. The treated broke slurry was added in an amount of 10% dry broke weight to dry fiber. After 40 seconds of mixing following addition of the treated broke, a retention aid was added in the amount of 0.5 lb/ton. The furnish Was then allowed to mix for 10 seconds, a 30 ml aliquot was collected and discarded, to answer and untainted sample for analysis, and a 100 ml sample was collected and analyzed. Material retained on a 200 mesh screen represented retained material, with material passing through the screen (fines) representing unretained material. The retained material was dried and weighed, and the present retention calculated according to the following formula:

$$100\%: \frac{\text{Fines dry weight} \times 500\ \text{ml/liquid sample weight}}{\text{Total fines weight} \times 500\ \text{ml}/100\ \text{ml}}$$

To provide a first comparison, a 500 mL charge of the headbox stock was added to the Drainage-Jar, and untreated broke slurry was added at 10% dry broke weight on fiber from a 0.50% slurry. The remaining conditions and procedures in the Drainage Jar were identical to those specified above. To provide a second comparison, untreated broke was added to the headbox furnish with no retention aid addition. After the coated broke was added, the furnish was allowed to mix for 50 seconds, a 30 ml aliquot collected and discarded, and a 100 ml sample collected for analysis.

The results of these experiments are shown below:

TABLE 7*

| | Total Retention |
|---|---|
| Invention (treated broke) | 85.4% |
| Control (untreated broke with retention aid) | 65.5% |
| Control (untreated broke without retention aid) | 45.8% |

*Each retention value is the average of two tests.

This example illustrates that the use of pre-flocculated coated broke with a shearing force according to the present invention provides a surprising increase in retention over that achieved by the control processes.

Example 8

This example demonstrates the enhancement in properties of paper sheets prepared with treated coated broke slurries of the present inventive process as compared to sheets prepared without using the invention.

Pre-flocculated and untreated coated broke separately were added to headbox furnishes, and the combined furnishes were used to produce handsheets having a target basis weight of 40 pounds per 3,300 square feet. The broke and furnish materials were prepared as described in Example 7. To construct the handsheet using the coated broke treated in accordance with the invention, approximately 400 ml of fabricated furnish was added to a Drainage Jar under agitation at 750 RPM. Pretreated coated broke slurry (prepared as described in Example 7) was added to the furnish at 10 percent dry broke weight to dry furnish weight. After 40 seconds, a high molecular weight, medium charge density, quaternary cationic retention aid was added at a level of 0.5 pounds per ton. The furnish was allowed to mix for an additional 10 seconds and immediately transferred to a handsheet mold to form the sheet. As a control, the same process was used to prepare handsheets using an untreated repulped coated broke slurry instead of the treated slurry of coated broke.

Each handsheet was pressed for 5 minutes and then again for 2 minutes, dried on a drum dryer at 100° F. for approximately 20 minutes, then allowed to cure overnight at constant humidity. The handsheets were evaluated for internal bond, caliper, mullen, and basis weight by methods known in the art to yield the following results.

TABLE 8*

| | Internal Bond | Caliper | Mullen | Caliper | Basis Weight |
|---|---|---|---|---|---|
| Invention (treated broke) | 198 | 4.67 | 42.5 | 4.67 | 1.82 g/m$^2$ |
| Control (untreated broke) | 182 | 5.02 | 42.4 | 5.02 | 1.88 g/m$^2$ |

*Each value represents the average of five test results.

This example demonstrates that pre-flocculation of a coated broke slurry improves the internal bond strength and reduces sheet caliper as compared to paper prepared with conventional recycled broke pulp. It is believed that the coated broke treatment of the present invention reduced fiber bundling, thereby improving sheet formation. The basis weight of the paper sheet prepared in accordance with the invention was comparable to that of the control.

Example 9

The present example provides a comparison of retention properties as between a standard furnish provided with either an untreated coated broke slurry or a furnish containing pre-flocculated broke in accordance with the invention.

A coated broke slurry was treated in accordance with the procedure set forth in Example 7, except that instead of a polyacrylamide-based flocculant, a cationic starch flocculant having a DS in the range of 0.06–0.065 was used to flocculate the slurry at a 10% add-on level to dry broke.

A Dynamic Drainage Jar retention study as described in Example 7 was conducted comparing the application of this preflocculated broke slurry, and an unflocculated, conventional broke slurry. The results are set forth below:

TABLE 9*

| | Total Retention |
|---|---|
| Invention (treated broke) | 67.55% |
| Control (untreated broke) | 56.22% |

*Each value is the average of two measurements.

This example further demonstrates the enhancements in retention provided by the invention.

Example 10

This Example comparatively illustrates retention in a paper furnish prepared in accordance with the invention with a simulated conventional method of preparing paper using coated broke.

A common practice in the paper industry is to apply a coagulant, such as DADMAC, in the broke chest of a paper machine. To simulate this, a sample of untreated broke slurry was agitated at 500 RPM in a beaker. After ten seconds of agitation, 10 lb/ton DADMAC was added to the beaker and agitated for an additional 20 seconds. This agitated broke was evaluated for retention properties in conjunction with a paper furnish as in accordance with Example 7. For comparison, an untreated broke was also tested. A broke slurry treated in accordance with the invention using a 10% add-on level of polyacrylamide flocculant as described previously also was prepared and evaluated. The following results were obtained:

TABLE 10*

| | Total Retention |
|---|---|
| Invention (treated broke) | 74% |
| Control (untreated coated broke) | 54% |
| Control (agitated broke) | 62% |

*Each value represents the average of two measurements.

This example further demonstrates the improvement in retention properties over conventional methods, including the simulated application of a coagulant in the broke chest.

Example 11

The paper furnishes of Example 10 were used to prepare handsheets in a handsheet mold. The handsheets thus prepared were analyzed for tensile strength, opacity, and basis weight. The results are shown below:

TABLE 11*

| | Tensile Strength | Opacity | Basis Weight |
|---|---|---|---|
| Control (agitated broke) | 20.5 | 80.03 | 30.92 |
| Invention (treated broke) | 19.6 | 77.96 | 31.33 |
| Control (untreated broke) | 18.3 | 77.39 | 29.23 |

*Each value represents the average of four test results.

This example demonstrates that pretreating coated broke according to the present invention provides a paper sheet that is improved over sheets prepared using conventional methods.

Thus, it is seen that the foregoing general objects have been satisfied. The invention provides a process for incorporating a filler into a newsprint or other low-grade furnish by using a pre-flocculated filler. Surprisingly, when a web of paper is prepared from the furnish, many properties of the web are improved as compared with webs that have been otherwise prepared. The process of the invention is useful not only in the preparation of handsheets, but also in large-scale newsprint manufacturing operations. In other aspects, the invention provides a process for preparing a paper web from a slurry that contains coated broke.

While particular embodiments of the invention have been shown, it will be understood that the invention is not limited thereto since modifications may be made by those skilled in the art, particularly in light of the foregoing teachings. It is, therefore, contemplated by the appended claims to cover any such modifications as incorporate those features, which constitute the essential features of these improvements within the true spirit and scope of the invention. All references cited herein are hereby incorporated by reference in their entireties.

What is claimed is:

1. A process for treating a fibrous slurry of coated broke, comprising the steps of:

providing a repulped slurry of coated broke, said slurry containing fibers and particles of coating residue;

adding a chemical flocculant to said slurry in an amount effective to form floccs of said fibers and said particles of coating residue; and applying a shearing force to said slurry, said shearing force being sufficient to limit the size of said floccs to a size that is effective to enhance the retention of said floccs in a paper web.

2. A process according to claim 1, wherein said floccs have an average particle size after shearing in the range of 30 to 75 microns.

3. A process according to claim 1, wherein said flocculant is selected from the group consisting of water soluble vinyl polymers, gums, polyacryamide, polyDADMAC, aluminum sulfate, mannogalactanes, and charged starch derivatives.

4. A process according to claim 1, wherein said chemical flocculent is added in an amount ranging from about 0.05% to about 60% by weight of broke material in said slurry.

5. A process according to claim 1, wherein said chemical flocculant is added in an amount ranging from about 5% to about 15% by weight of broke material in said slurry.

* * * * *